US010850812B2

(12) United States Patent
Williams et al.

(10) Patent No.: US 10,850,812 B2
(45) Date of Patent: Dec. 1, 2020

(54) MODULAR LEANING POST FOR BOATS

(71) Applicant: Marine Accessories Corporation, Knoxville, TN (US)

(72) Inventors: Anthony Duane Williams, Alcoa, TN (US); Chris Hill, Knoxville, TN (US); John Clarke, Knoxville, TN (US)

(73) Assignee: Marine Accessories Corporation, Knoxville, TN (US)

( * ) Notice: Subject to any disclaimer, the term of this patent is extended or adjusted under 35 U.S.C. 154(b) by 0 days.

(21) Appl. No.: 16/456,642

(22) Filed: Jun. 28, 2019

(65) Prior Publication Data

US 2020/0001949 A1 Jan. 2, 2020

Related U.S. Application Data

(60) Provisional application No. 62/691,050, filed on Jun. 28, 2018.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ... B63B 29/04; B63B 2029/043; B63B 17/00; B63B 29/02; B60N 2/20; A47C 7/62
USPC ..... 114/363
See application file for complete search history.

(56) References Cited

U.S. PATENT DOCUMENTS

| | | | | |
|---|---|---|---|---|
| 4,428,617 | A * | 1/1984 | Lawson | A01K 97/06 114/363 |
| 4,893,578 | A * | 1/1990 | Doerfer | B63B 29/04 114/363 |
| 5,251,359 | A * | 10/1993 | Finkl | E05D 11/06 16/348 |
| 6,402,247 | B1 * | 6/2002 | Schmitt | B60N 2/203 297/357 |
| 7,422,279 | B2 * | 9/2008 | Kushner | A01K 97/06 297/188.12 |
| 7,819,483 | B2 * | 10/2010 | Kushner | A01K 97/10 297/452.2 |
| 9,821,877 | B2 * | 11/2017 | Tsai | F16F 9/0236 |
| 9,821,887 | B1 * | 11/2017 | Wilson | B60N 2/203 |
| D819,540 | S * | 6/2018 | Wilson | D12/317 |
| 2009/0188421 | A1 * | 7/2009 | Devine | B63B 29/04 114/363 |
| 2013/0312653 | A1 * | 11/2013 | Hinson | B63B 17/00 114/363 |

OTHER PUBLICATIONS

Boat Outfitters Leaning Post with Removable Soft Storage Bag.

* cited by examiner

*Primary Examiner* — Anthony D Wiest
(74) *Attorney, Agent, or Firm* — Luedeka Neely Group, P.C.

(57) ABSTRACT

A modular leaning post kit for a boat includes a seat base and a pair of seat legs, the seat base being removably installable onto the seat legs to provide an assembled leaning post structure, and the assembled leaning post structure being installable onto a boat. Additional leaning post structures that may optionally be added onto the assembled leaning post structure, comprising one or more of a foot rest, a grab rail, a back rest/fishing rod holder, an upholstered seat top, and an upholstered back rest.

6 Claims, 21 Drawing Sheets

MODULAR LEANING POST FOR BOATS

CROSS-REFERENCE TO RELATED APPLICATION

This application claims priority to U.S. Provisional Application No. 62/691,050 filed Jun. 28, 2018, entitled MODULAR LEANING POST FOR BOATS, incorporated herein by reference in its entirety.

FIELD

This disclosure relates to the field of boat leaning posts. More particularly, this disclosure relates to a modular leaning post structure.

BACKGROUND

Leaning posts are commonly provided on recreational watercraft. Leaning posts are commonly configured as elevated seat structures on which a cushion may be placed, but which also are suitable as a back support for a person standing to lean against. Leaning posts are often located so that the boat operator may stand and use the leaning post for stability while operating the boat. Leaning posts are particularly desired by fisherman, as fishing rod holders may be attached to the leaning post.

Leaning posts are generally provided as rigid structures made of welded aluminum tubing. The leaning posts are constructed off-site as a unitary structure that is attached to the floor of the boat. As such, they are bulky and expensive to ship. Also, they are not customizable except at the time of construction.

What is desired is a leaning post structure that is of modular and adjustable design, and which may be disassembled for compact shipping.

SUMMARY

The above and other needs are met by a modular leaning post kit and installation method according to the disclosure.

In one aspect, a modular leaning post kit includes a seat base and a pair of seat legs, the seat base being removably installable onto the seat legs to provide an assembled leaning post structure, and the assembled leaning post structure being installable onto a boat. Additional leaning post structures that may optionally be added onto the assembled leaning post structure, comprising one or more of a foot rest, a grab rail, a back rest/fishing rod holder, an upholstered seat top, and an upholstered back rest.

In another aspect, a method for shipping and then installing a leaning post on a boat, includes the steps of: providing as separate unconnected pieces a seat base and a pair of seat legs; packaging the seat base and the pair of seat legs for shipment; shipping the packaged seat base and seat legs to a location for assembly and installation onto a boat; unpacking the packaged seat base and seat legs at the location; installing the unpacked seat base onto the unpacked seat legs to provide an assembled leaning post; and installing the assembled leaning post onto a boat.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, there are shown modular leaning posts according to the disclosure.

Figure 1A:
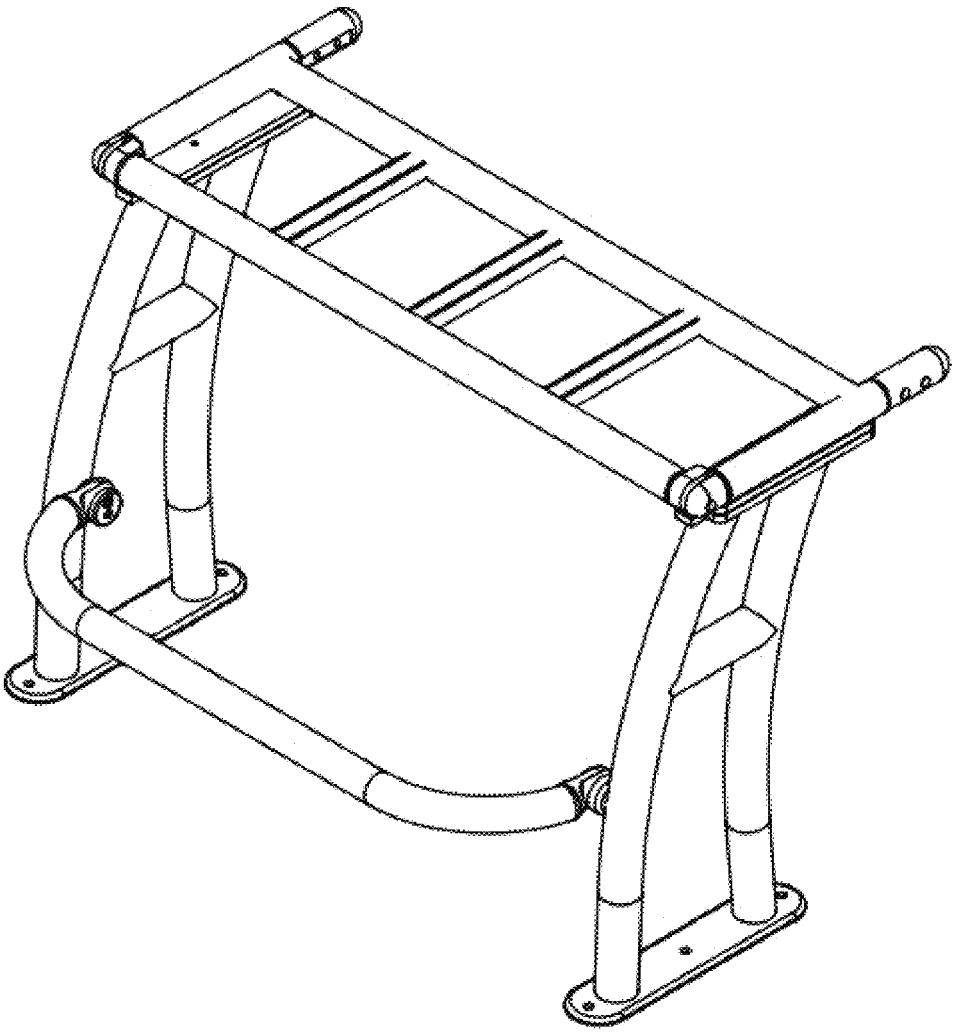
FIG. 1A is a perspective view of an assembled modular leaning post according to the disclosure.
Figure 1B:
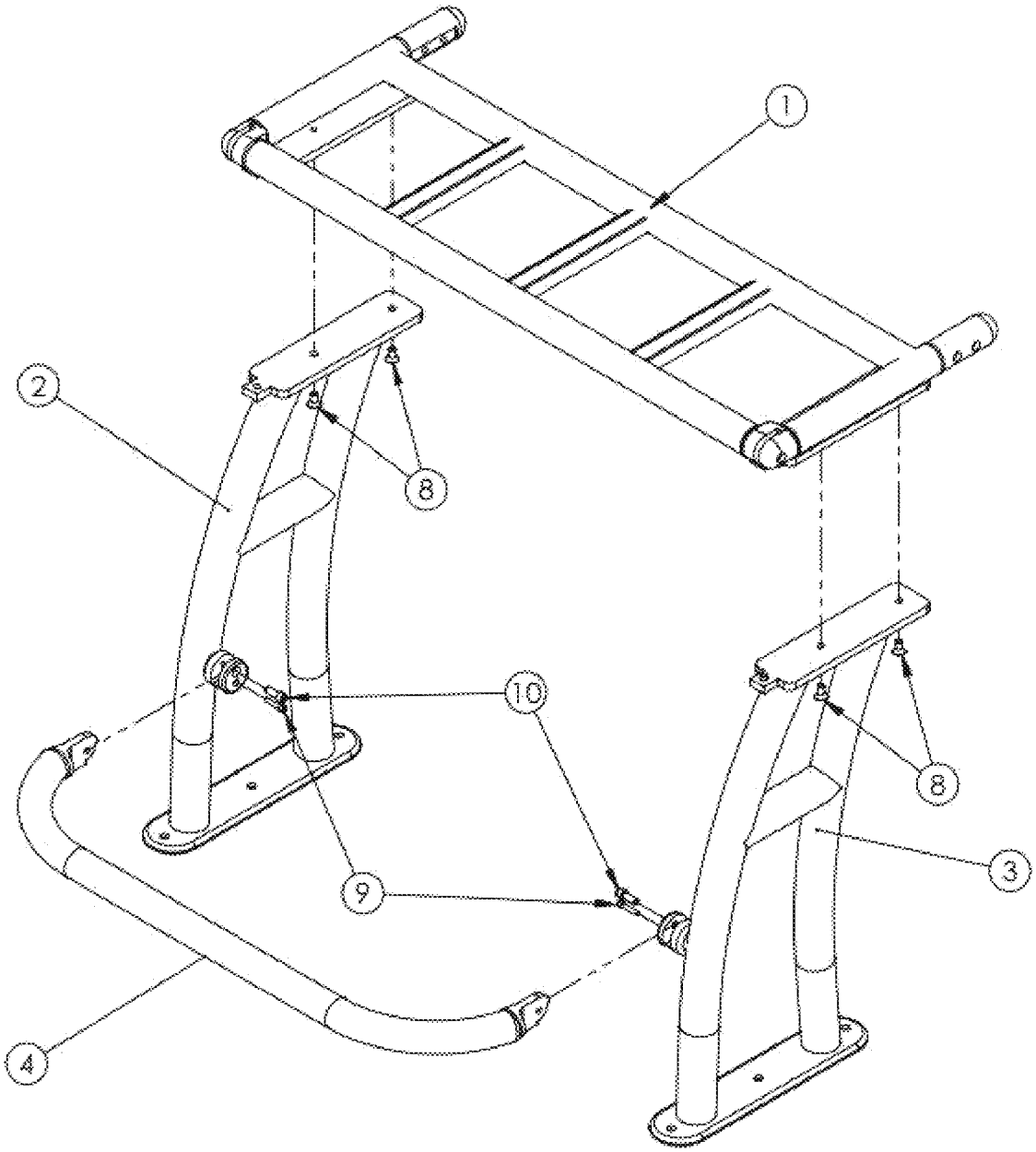
FIG. 1B is an exploded view thereof.

FIG. 1A is a perspective view of an assembled modular leaning post according to the disclosure, and FIG. 1B is an exploded view thereof. As shown, the leaning post includes as its basic structure to include a seat base 1, seat legs 2 and 3. Additional features that may be installed as part of a leaning post kit include a foot rest 4 and other features, such as a grab rail, a back rest/fishing rod holder, an upholstered seat top, and an upholstered back rest, as shown herein more fully below.

Leaning posts according to the disclosure are advantageous over prior art welded leaning posts. For example, the leaning posts are of modular and adjustable design, and may be disassembled for compact shipping. Also, the modular structure enables a user to initially buy and install the basic leaning post structure provided by the seat base 1 and the legs 2 and 3, and thereafter install additional features as described herein and change the features to reconfigure the leaning post.

The seat base 1 is attached to the seat legs 2 and 3 as by fasteners 8 to provide a basic assembly. The assembled leaning post may then be installed on a boat as by attaching bases of the seat legs 2 and 3 to the boat floor or other substructure. The seat base 1 as shown includes cross-pieces to which from soft cooler or dry bags may be installed for added storage space. The foot rest 4 is attached to receivers of the seat legs 2 and 3 as by fasteners 9 and 10. The foot rest 4 may be added before or after installation of the leaning post onto the boat.

The components of the leaning post are desirably made from tube or pipe sizes ranging 1⅝" up to 3" diameter and made from aluminum 6061 grades to meet ABYC H-31 requirements for Type A driver seats.

Figure 2A:
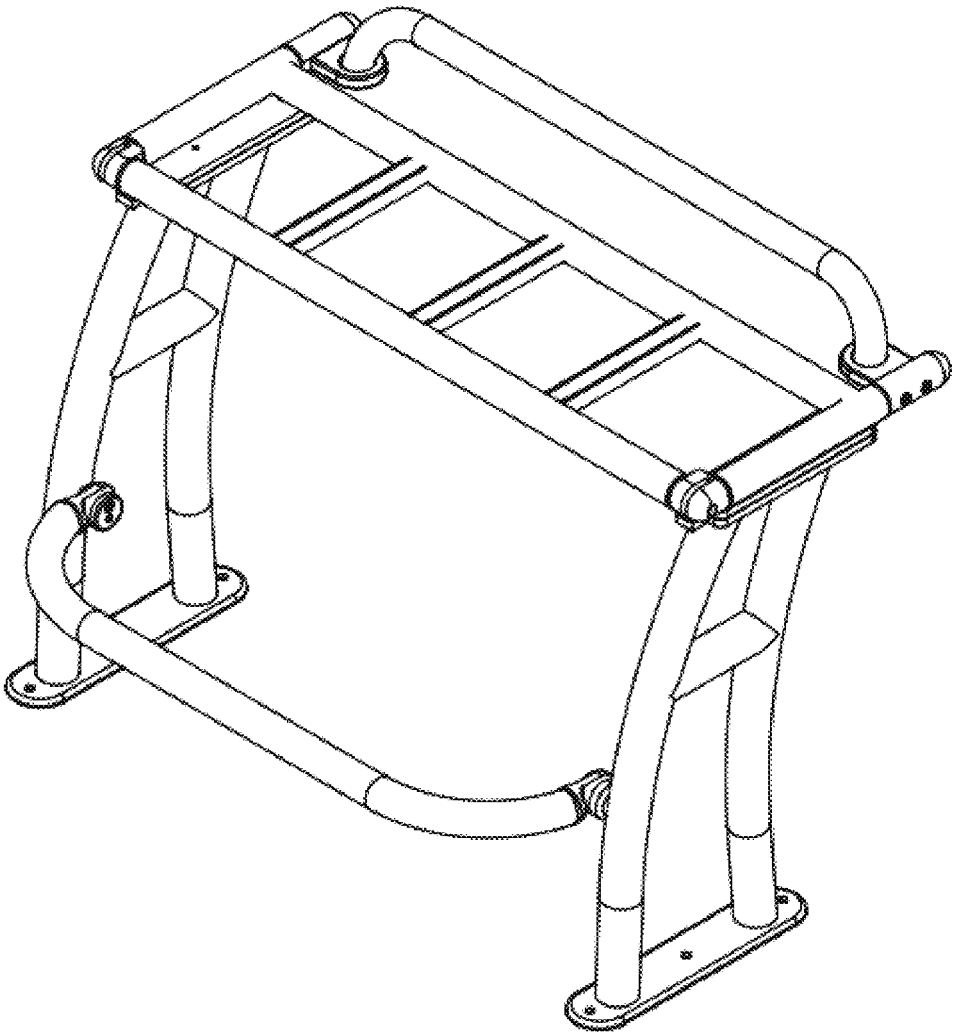
FIG. 2A is a perspective view of an assembled modular leaning post having a grab rail according to the disclosure.
Figure 2B:
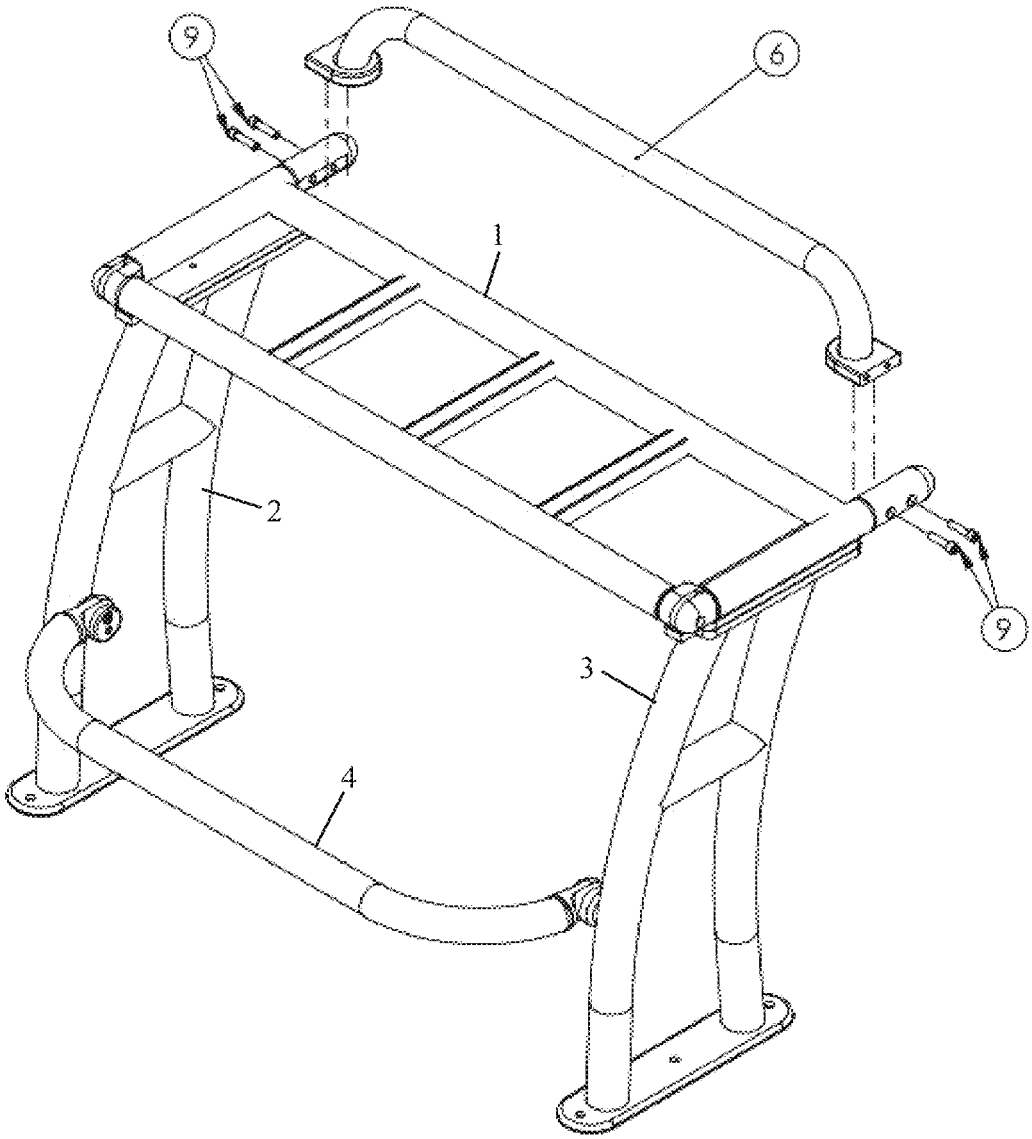
FIG. 2B is an exploded view thereof.

FIG. 2A is a perspective view of an assembled modular leaning post having the foot rest 4 and also a grab rail 6 according to the disclosure. FIG. 2B is an exploded view of FIG. 2A. As will be noted, the grab rail 6 is installable onto the seat base 1 by use of fasteners 9.

Figure 3A:
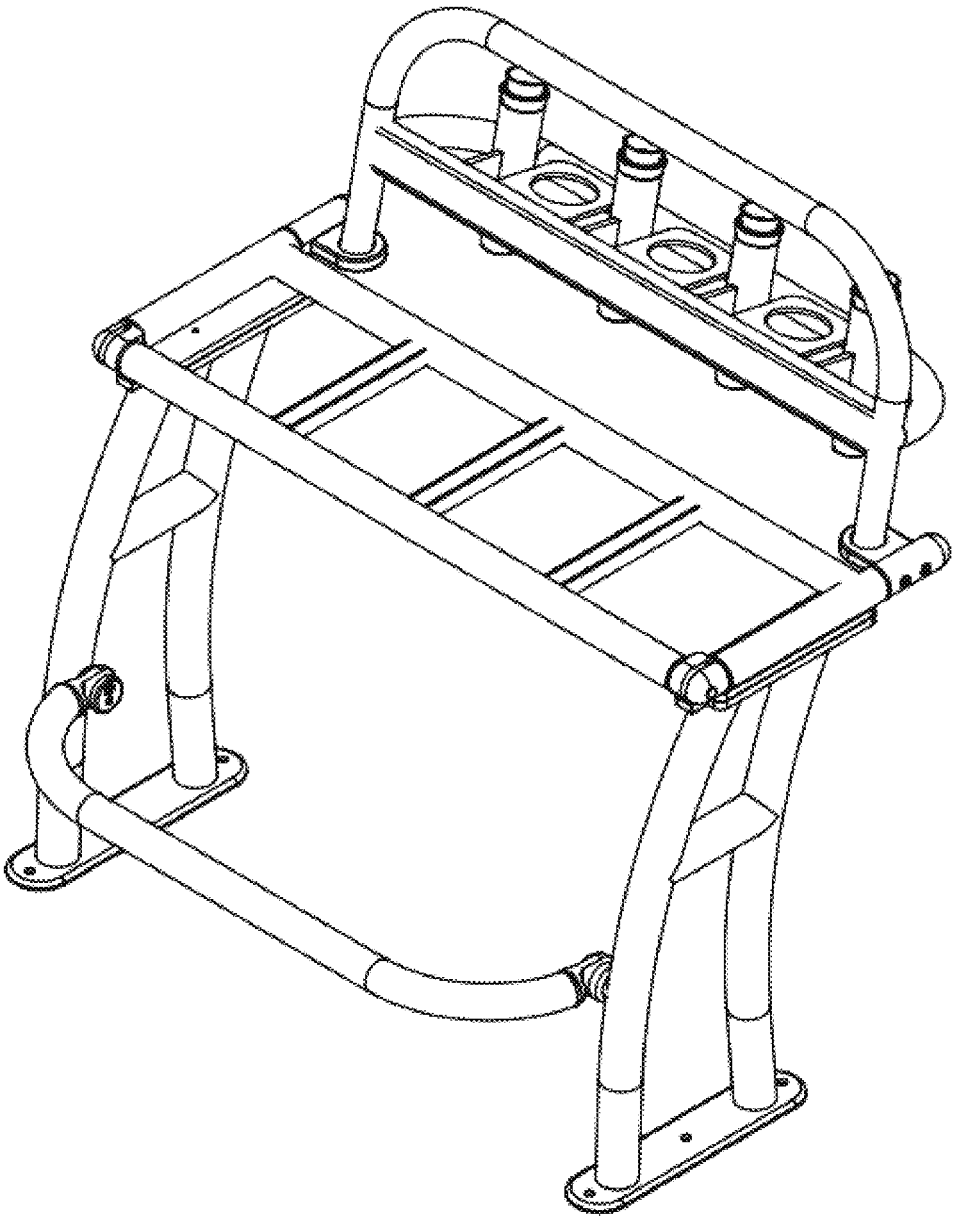
FIG. 3A is a perspective view of an assembled modular leaning post having a back rest/fishing rod holder according to the disclosure.
Figure 3B:
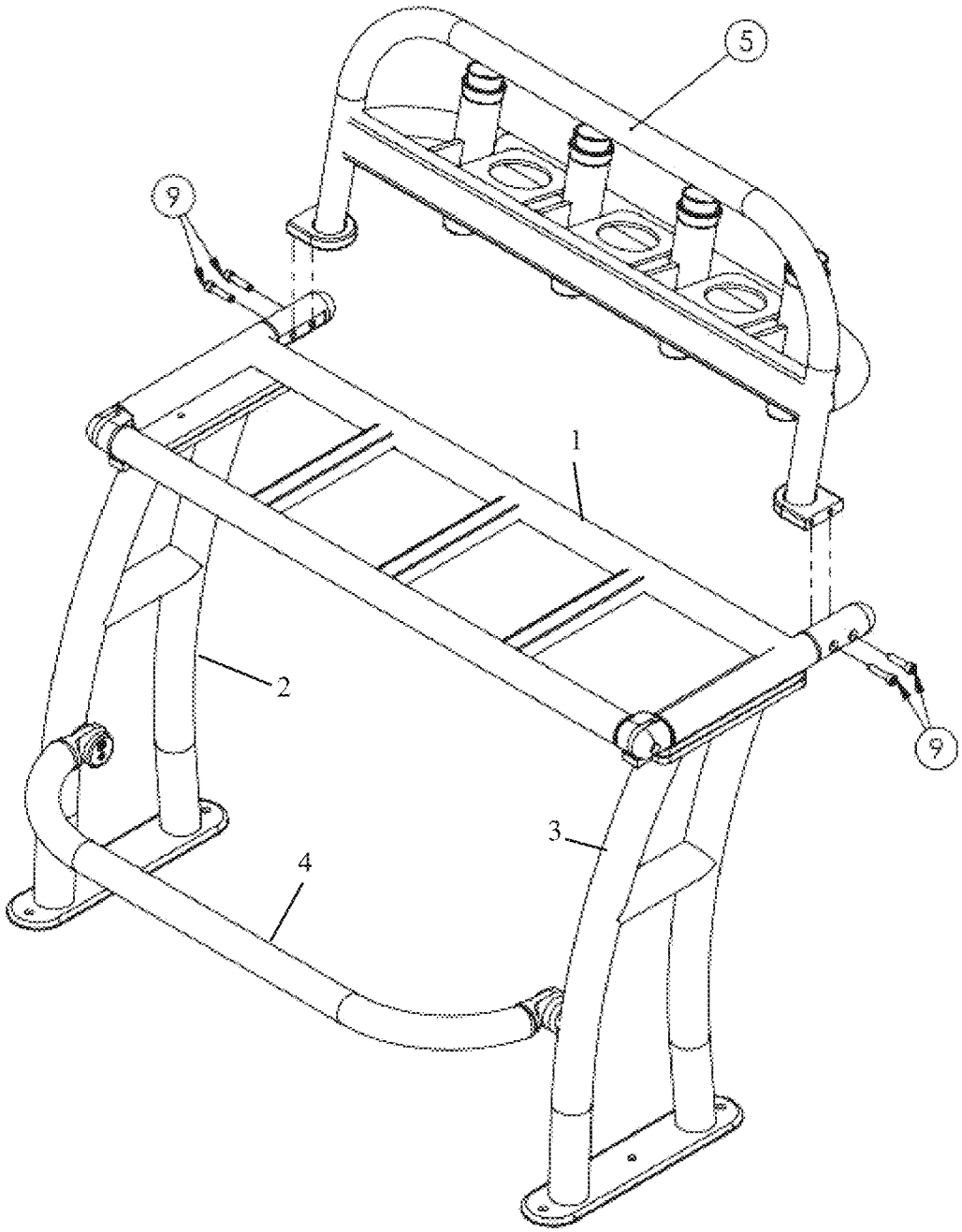
FIG. 3B is an exploded view thereof.

FIG. 3A is a perspective view of an assembled modular leaning post having the foot rest 4 and also a back rest/fishing rod holder 5 according to the disclosure. FIG. 3B is an exploded view of FIG. 3A. As will be noted, the back rest/fishing rod holder 5 is installable onto the seat base 1 by use of fasteners 9. The fishing rod holders may or may not be included.

Figure 4A:
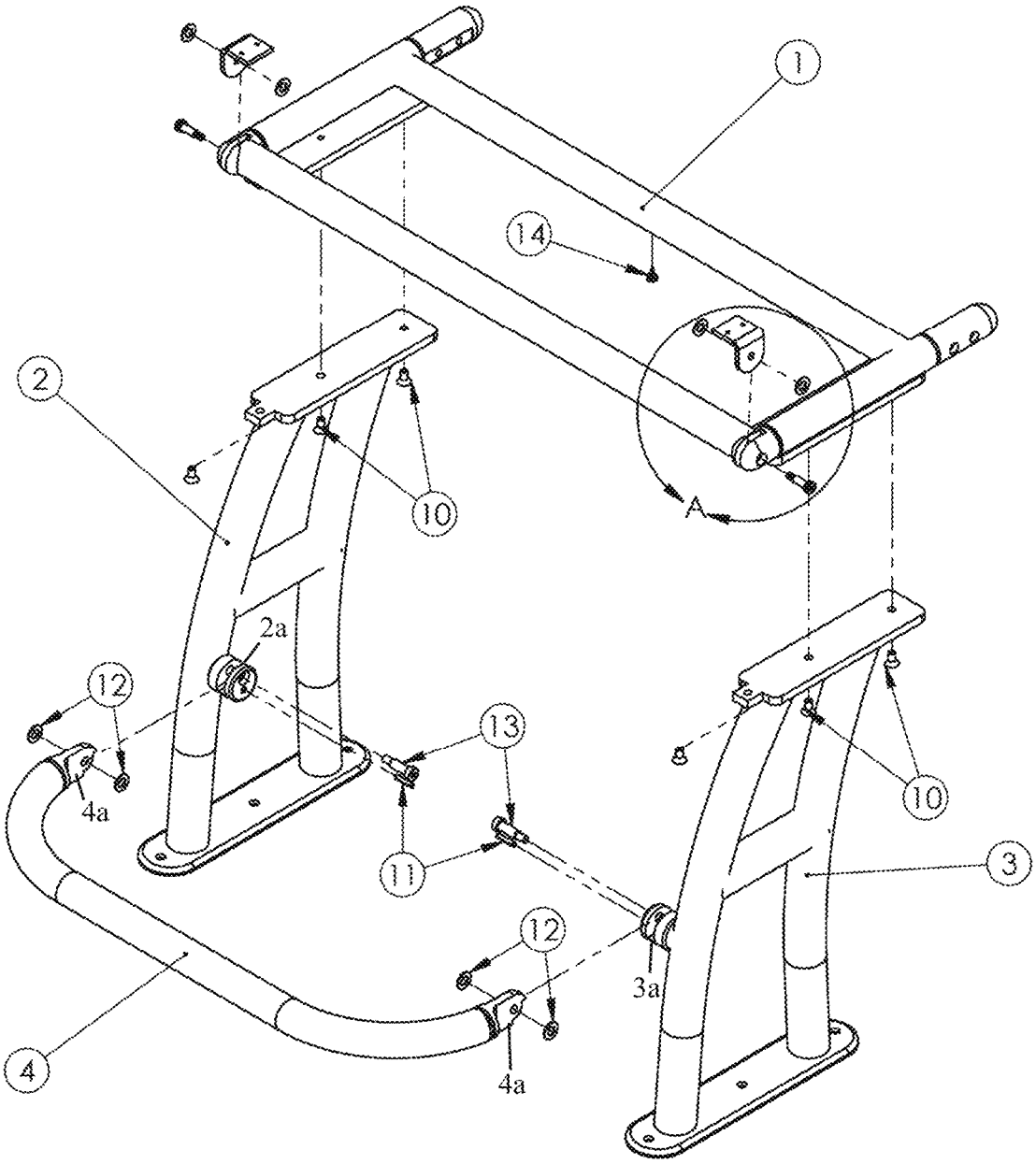
FIG. 4A is an exploded perspective view of an alternate embodiment of a modular leaning post according to the disclosure.
Figure 4B:
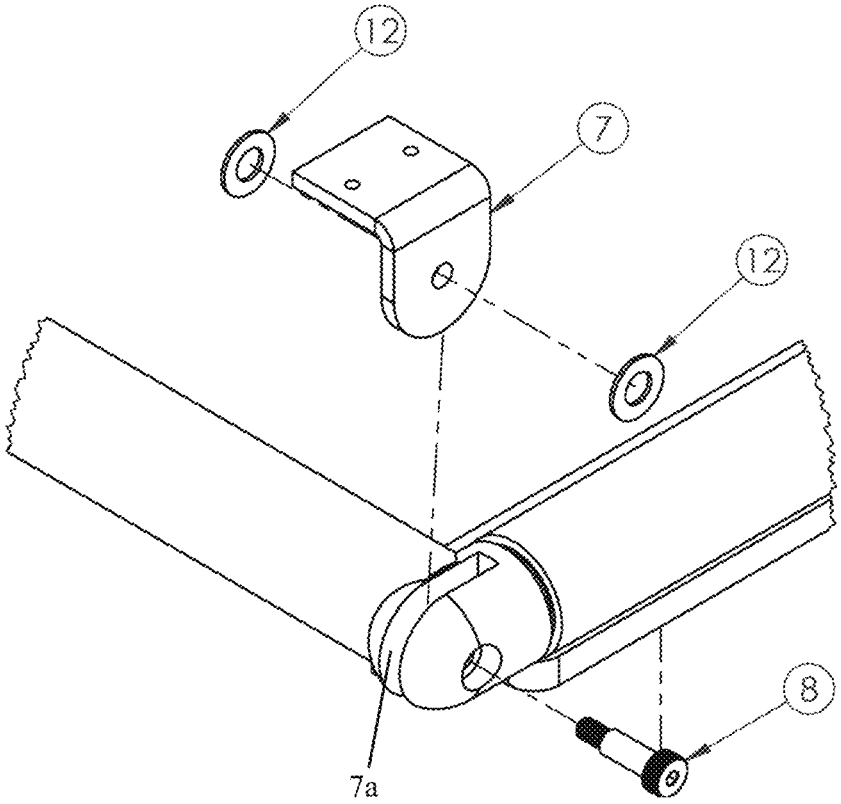
FIG. 4B is a close-up view of a portion thereof.

FIG. 4A is an exploded perspective view of another embodiment of a modular leaning post according to the disclosure, and FIG. 4B is a close-up view of a portion thereof. The leaning post is substantially similar to that of the embodiment of FIGS. 1A and 1B but includes pivotally mounted seat hinge brackets 7.

As shown, the leaning post includes a seat base 1, seat legs 2 and 3, and a foot rest 4. The seat base 1 is attached to the seat legs 2 and 3 as by bolts 10. The foot rest 4 has ends 4*a* pivotally attached to receivers 2*a* and 3*a* of the seat legs 2 and 3, respectively, as by spring pins 11, washers 12, and fasteners 13 so as to be adjustably positionable between either a level or a raised position.

As will be noted, the L-shaped seat hinge brackets 7 are pivotally pinned to the seat base 1 by use of fasteners 8 and washers 12. In this regard, as seen in FIG. 4B, the seat base includes channels 7*a* machined therein into which the brackets 7 are located so as to be recessed into the seat base 1. The channels 7*a* cooperate with the brackets 7 to provide recessed mounting and an increased range of swing, as described more fully below. An upholstered seat top or the like may be attached to the brackets 7, which enable the seat top to be rotated forward to allow access to the storage space under the seat base.

Figure 5A:
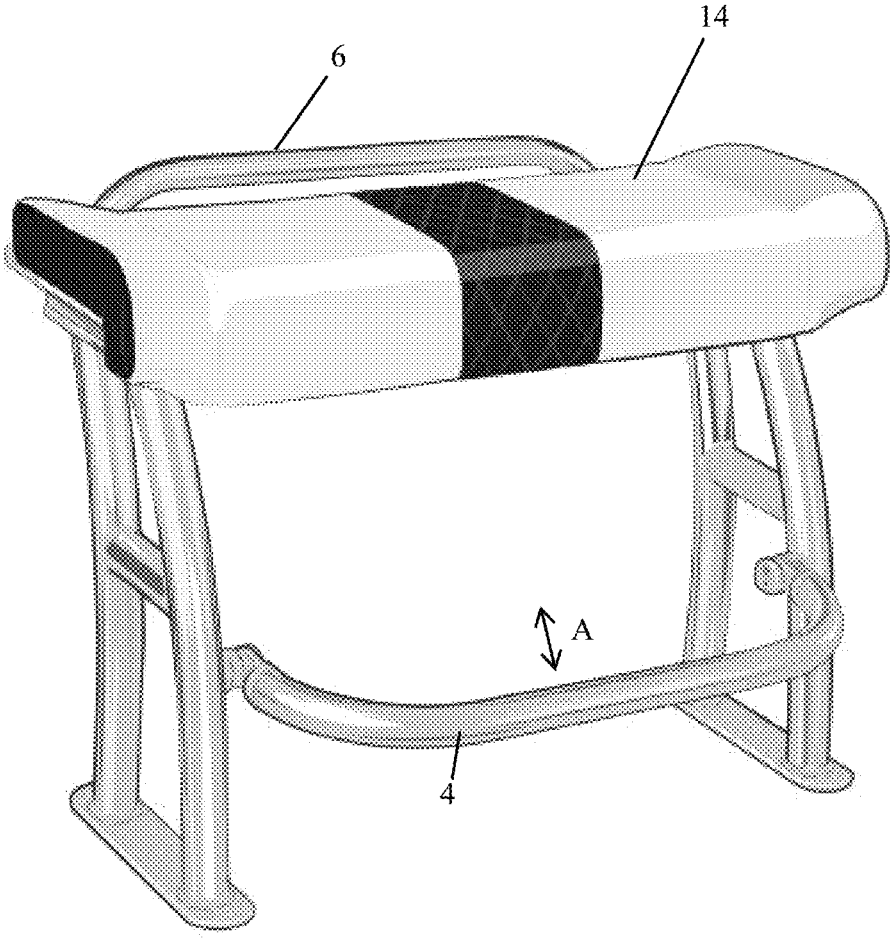
FIG. 5A is a perspective view of an assembled modular leaning post having a grab bar feature according to the disclosure.
Figure 5B:
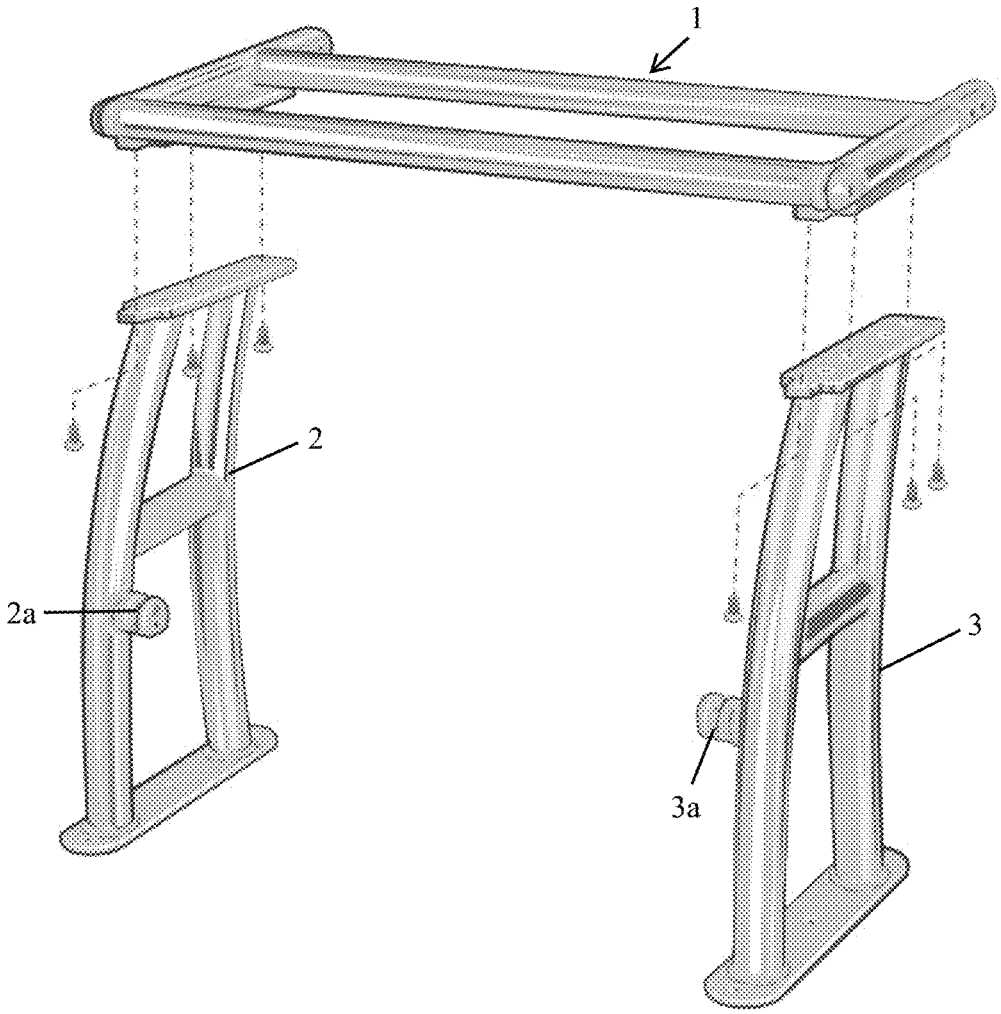
FIGS. 5B-5G depict steps in the assembly of the leaning post of FIG. 5A and features of the leaning post.

FIG. 5A is a perspective view of an assembled modular leaning post having the grab rail 6 and an upholstered seat top 14 and the pivotally mounted seat hinge brackets 7 according to the disclosure.

FIGS. 5B-5G depict steps in the assembly of the leaning post of FIG. 5A and features of the leaning post. As depicted, the leaning post is assembled by installing the seat base 1 onto the legs 2 and 3, followed by installation of the foot rest 4, and then installation of the seat top 14. The grab rail 6 is then installed onto the seat base 1.

Figure 5C:
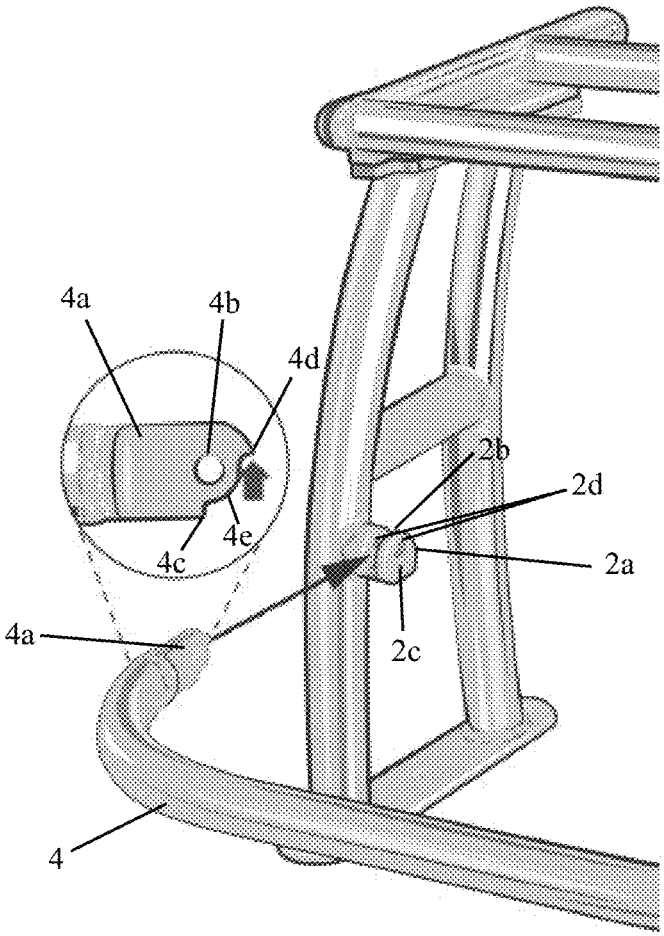
Figure 5D:
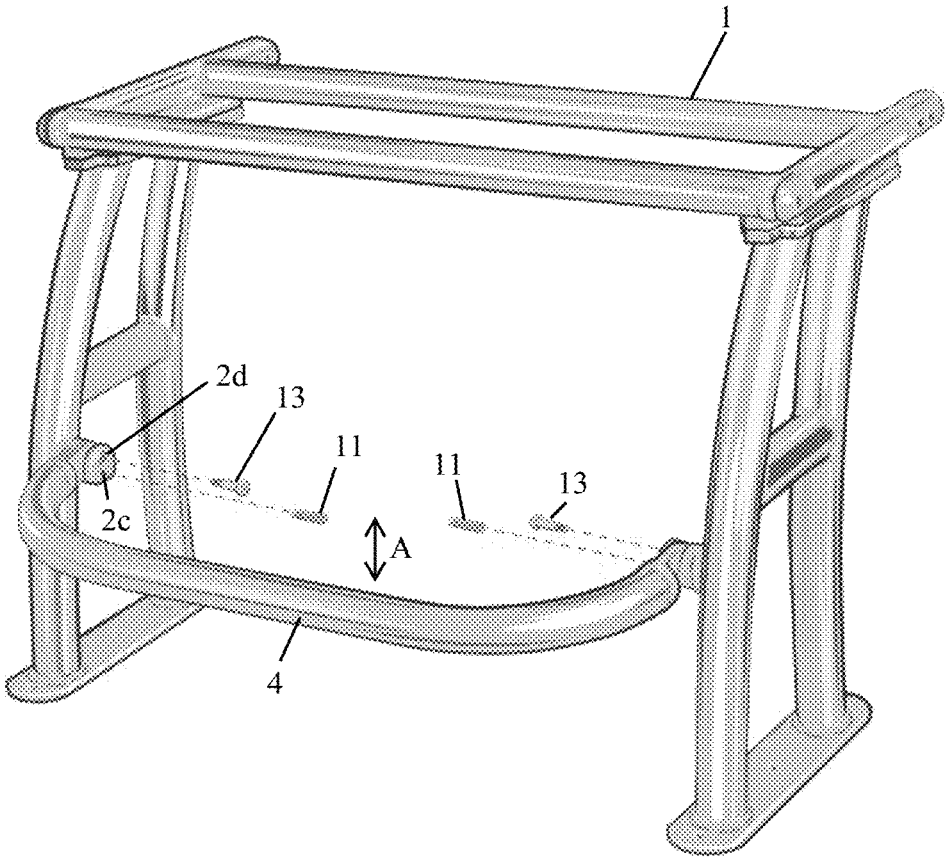
Figure 5E:
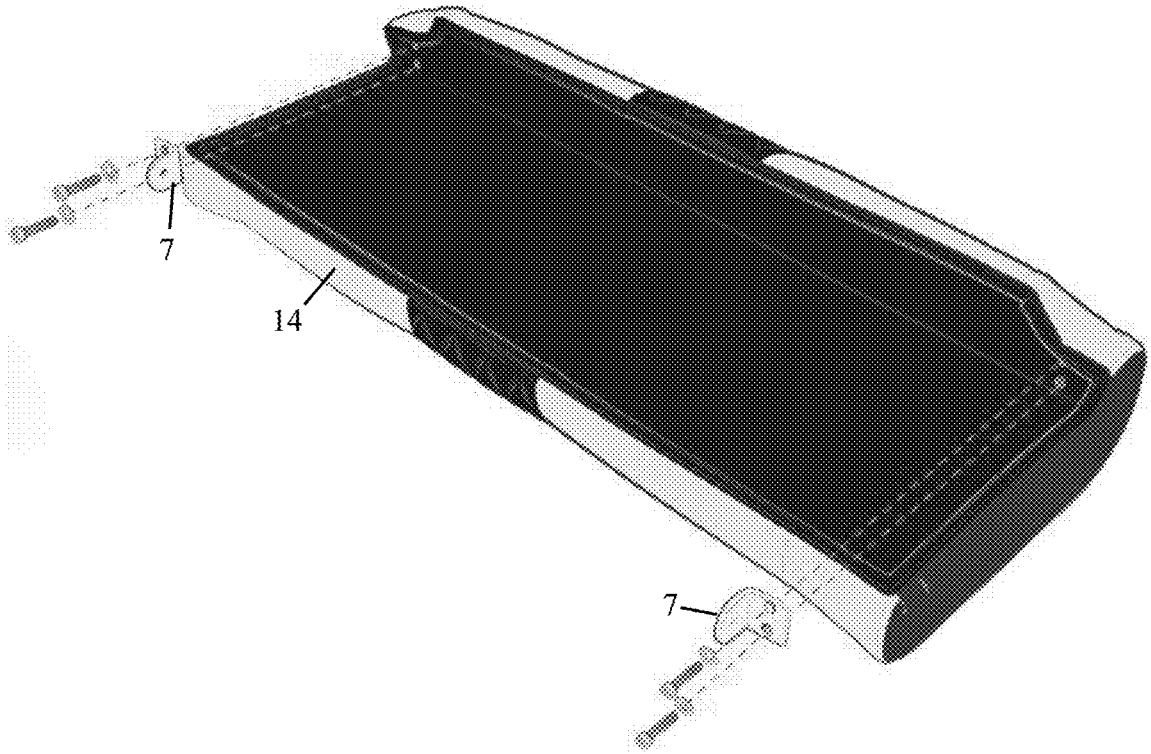
Figure 5F:
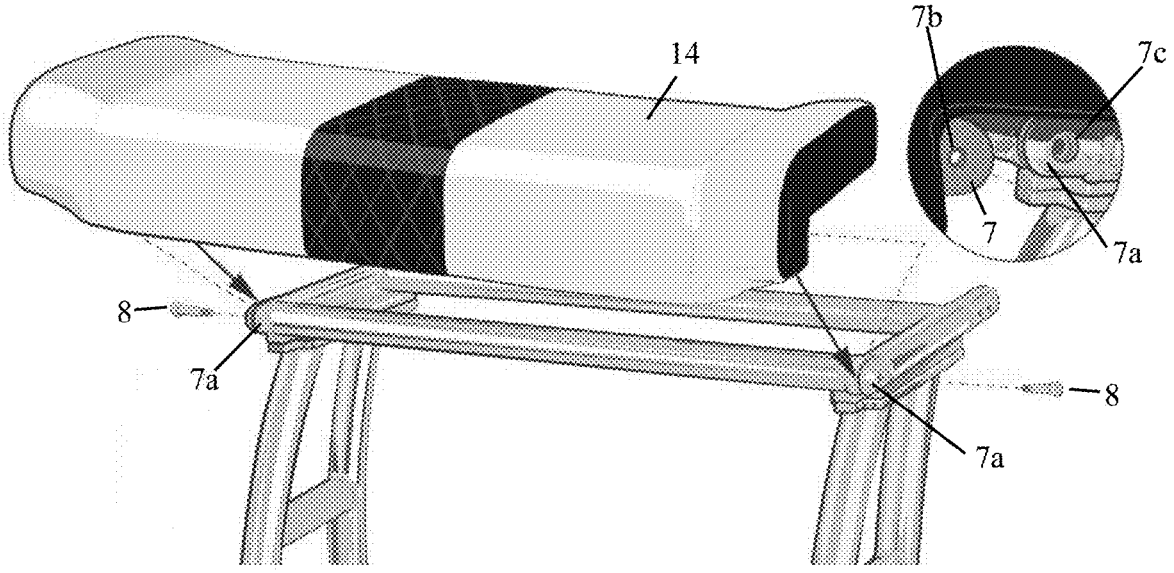
Figure 5G:
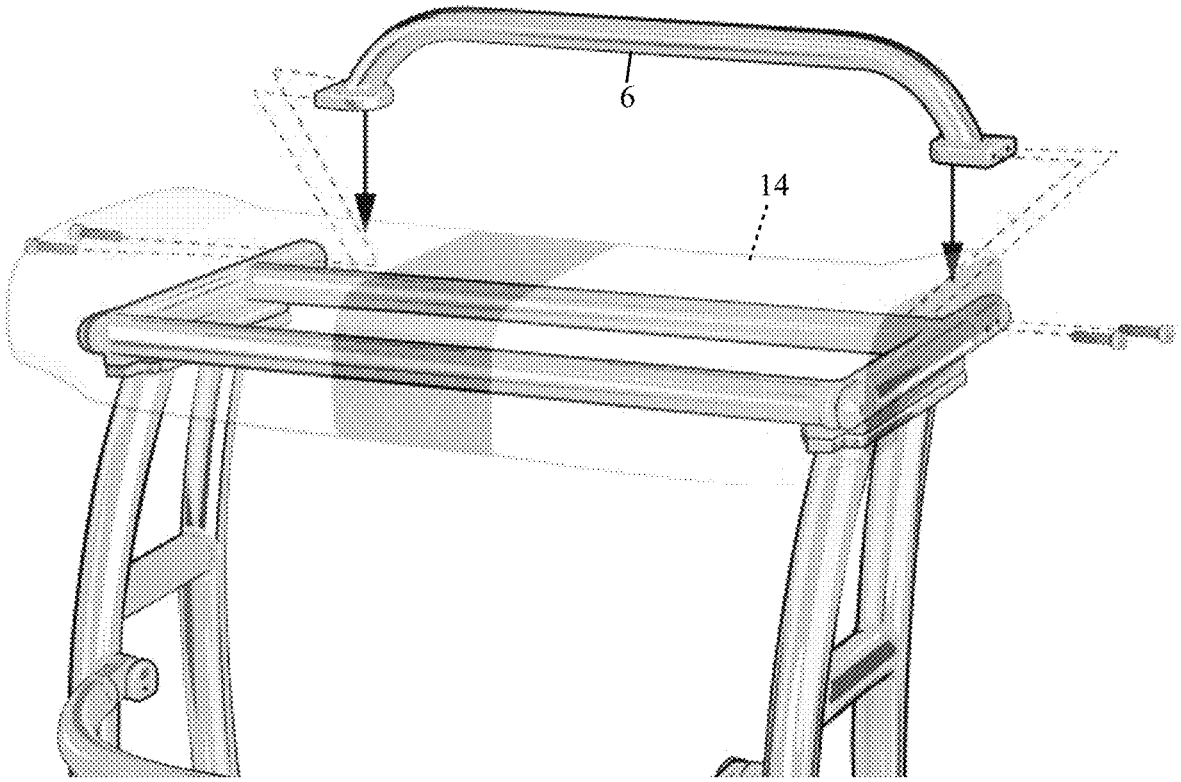

As shown in detail in FIGS. 5C and 5D, the end 4*a* of the foot rest 4 is shown configured to cooperate with the receiver 2*a* (and likewise the receiver 3*a*) to enable adjustable positioning of the foot rest 4 between either a level or a raised position as indicated by the arrow A. 5D shows the level position and as indicated by the arrow A, the foot rest 4 may be pivoted upwardly from the level position.

In this regard, the end 4*a* includes a central aperture 4*b*, stop surfaces 4*c* and 4*d*, and cam surface 4*e*. The cam surface 4*a* promotes smooth pivoting of the foot rest 4 between the level position and the raised position and the stop surfaces enable the foot rest to be maintained in the level position or the raised position.

The receiver 2*a* includes a recess 2*b* and apertures 2*c* and 2*d*. As will be noted, the apertures 2*d* are on opposite sides of the recess 2*b*. The end 4*a* of the foot rest 4 is received by the recess 2*b* with the aperture 4*b* aligned with the apertures 2*d*. The end 4*a* is pivotally mounted to the receiver 2*a* by passing the fastener 13 through the aligned apertures 4*b* and 2*d*, with the washers 12 on either side of the aperture 4*b*. The spring pin 11 may be inserted into through the aperture 2*c*. When the foot rest 4 is in the lowered position the stop 4*c* contacts the pin 11. When the foot rest 4 is in the raised position the stop 4*d* contacts the pin 11.

Figure 6A:
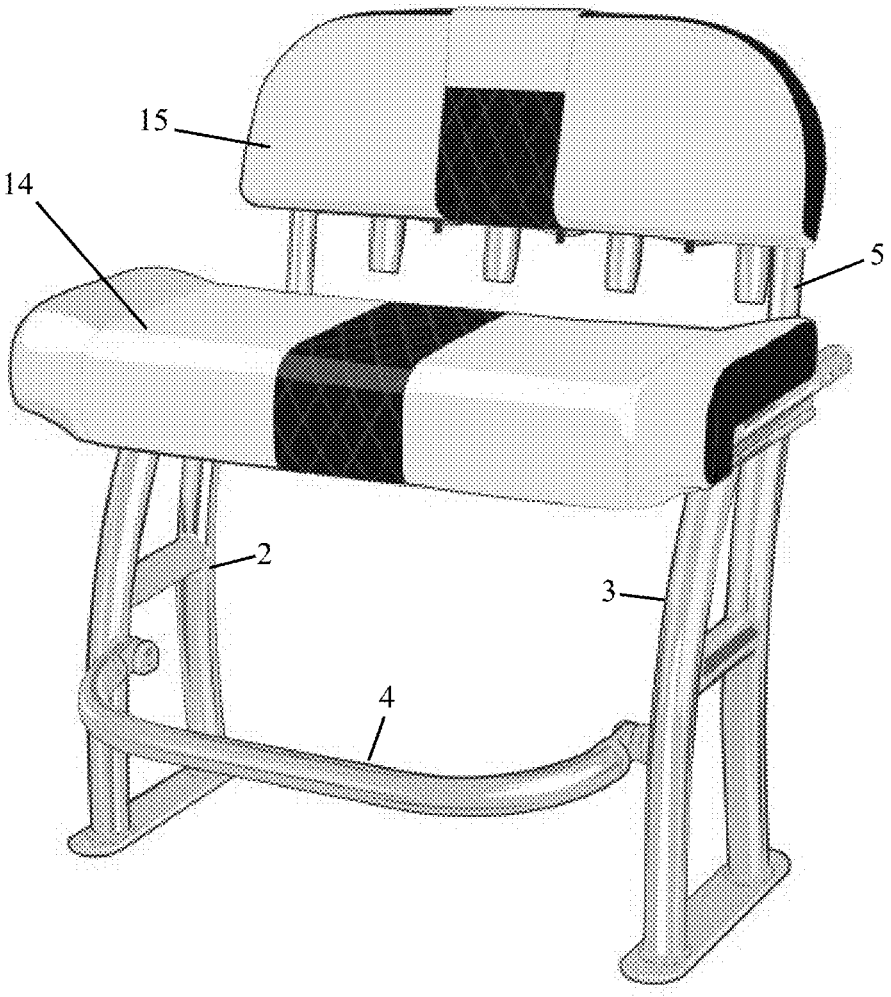
FIG. 6A is a perspective view of an assembled modular leaning post having a back rest/fishing rod holder feature according to the disclosure.
Figure 6B:
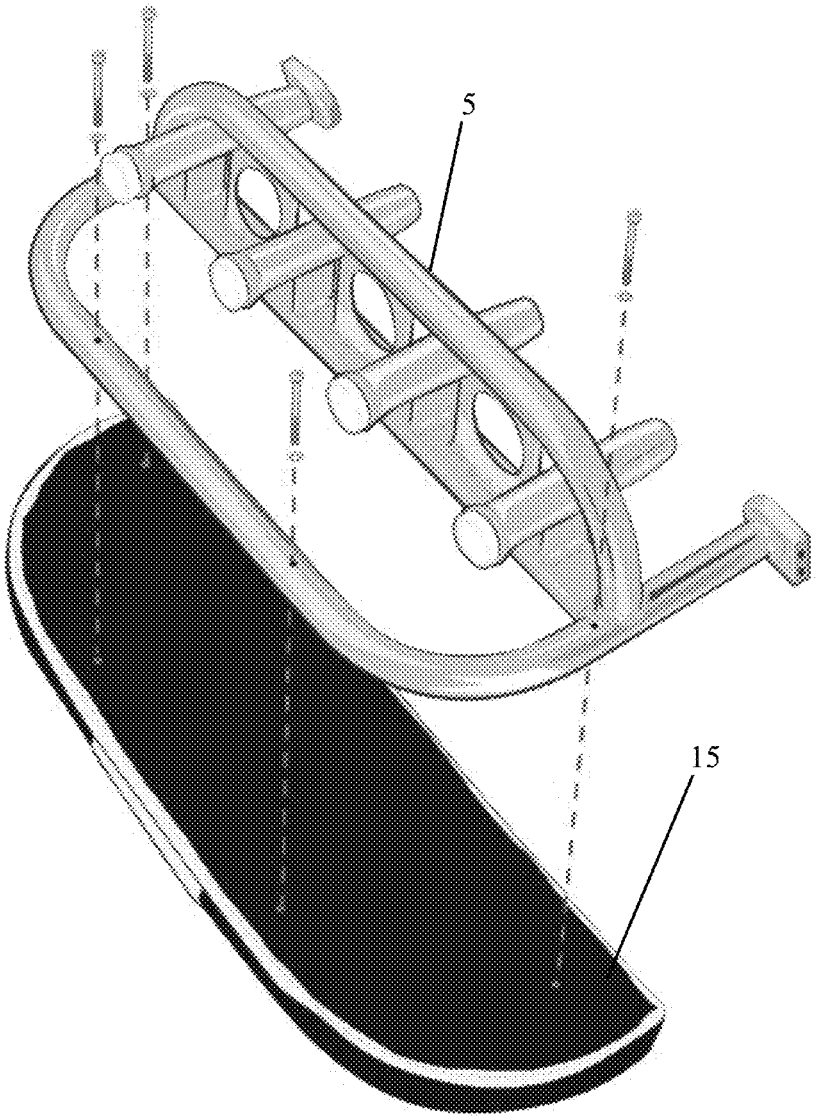
FIGS. 6B-6G depict steps in the assembly of the leaning post of FIG. 6A and features of the leaning post.

FIG. 6A is a perspective view of an assembled modular leaning post having a back rest/fishing rod holder 5 and an upholstered back rest 15 according to the disclosure.

FIGS. 6B-6E depict steps in the assembly of the leaning post of FIG. 6A and features of the leaning post. As depicted, the leaning post is assembled as previously described with the seat base 1 installed on the legs 2 and 3, followed by installation of the foot rest 4, and then installation of the seat top 14. After this, the upholstered back rest 15 is installed on the back rest/fishing rod holder 5, which is then installed onto the seat base 1 using fasteners.

Figure 6C:
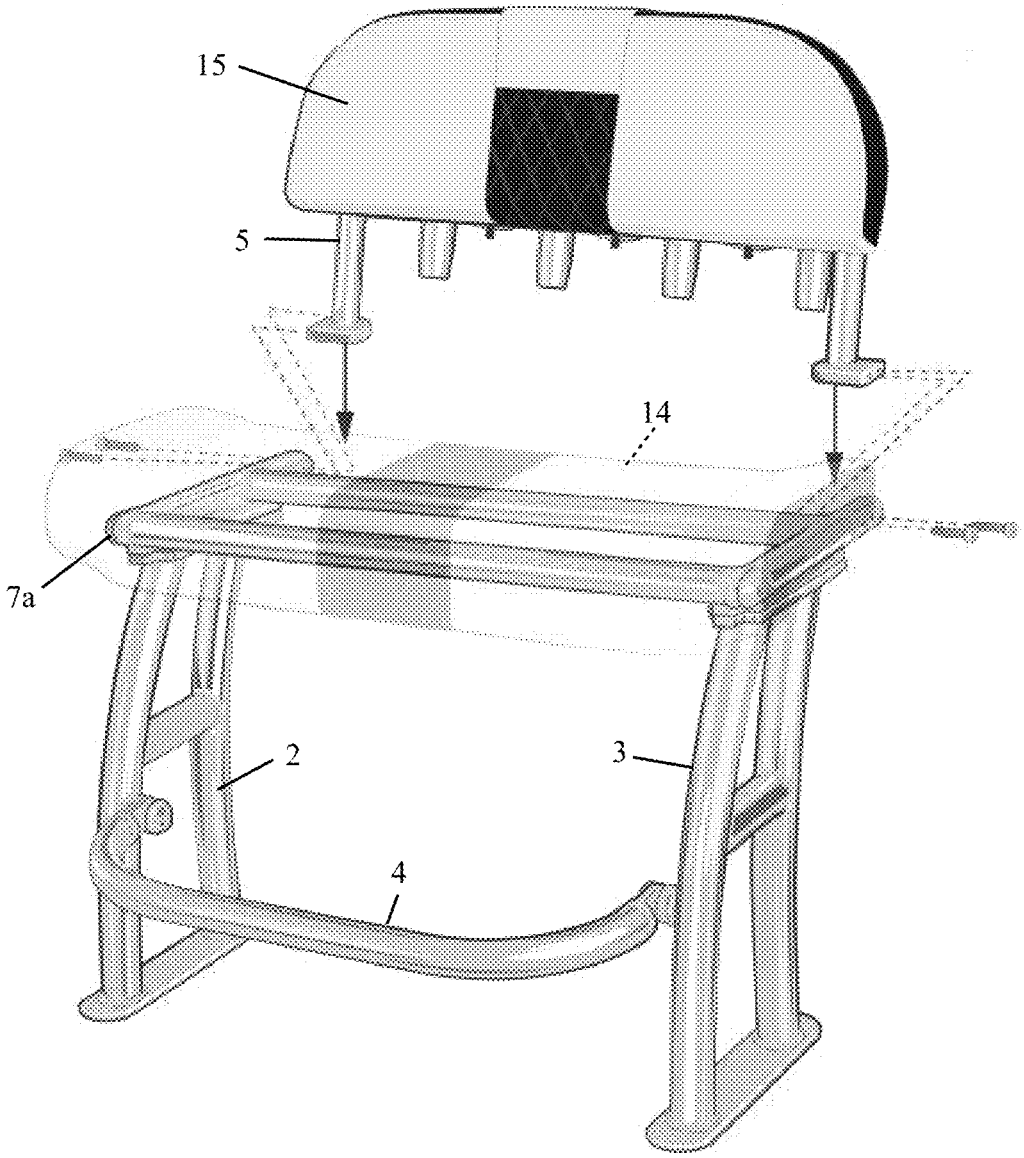
Figure 6D:
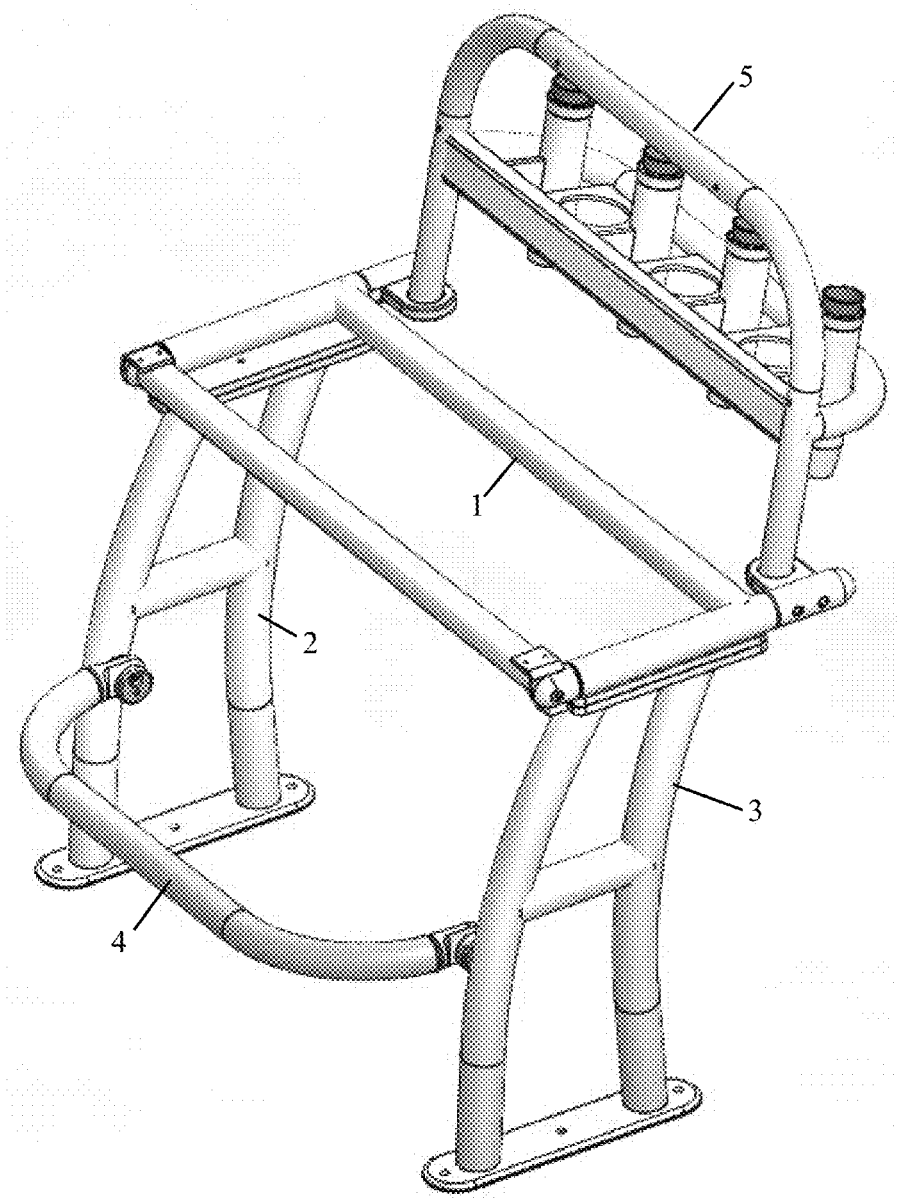
Figure 6E:
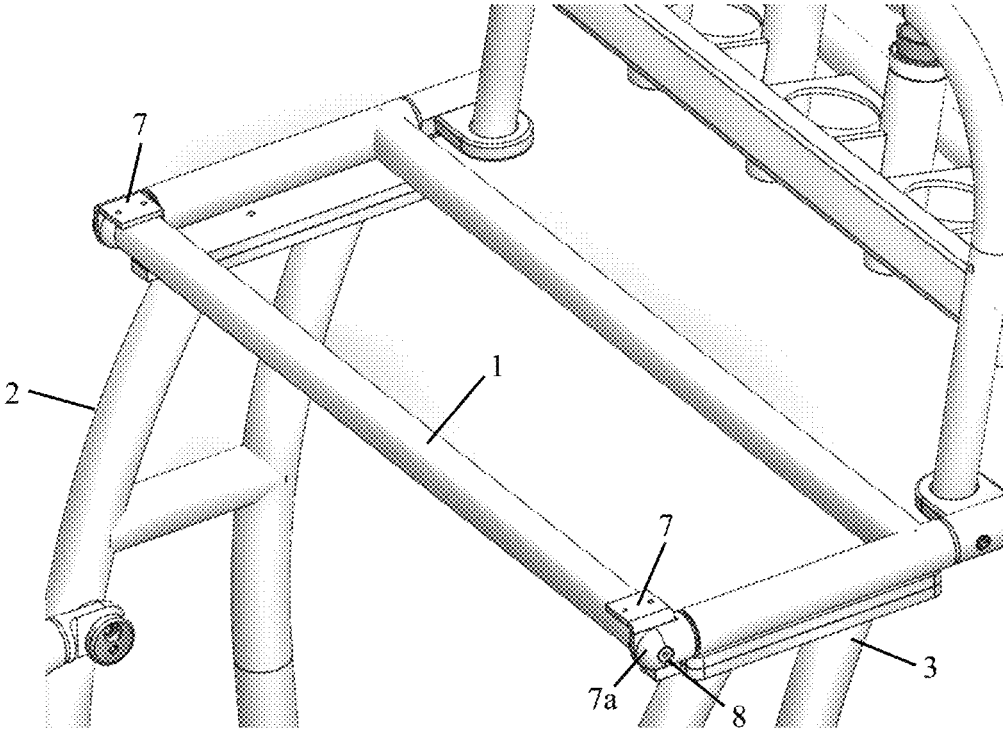
Figure 6F:
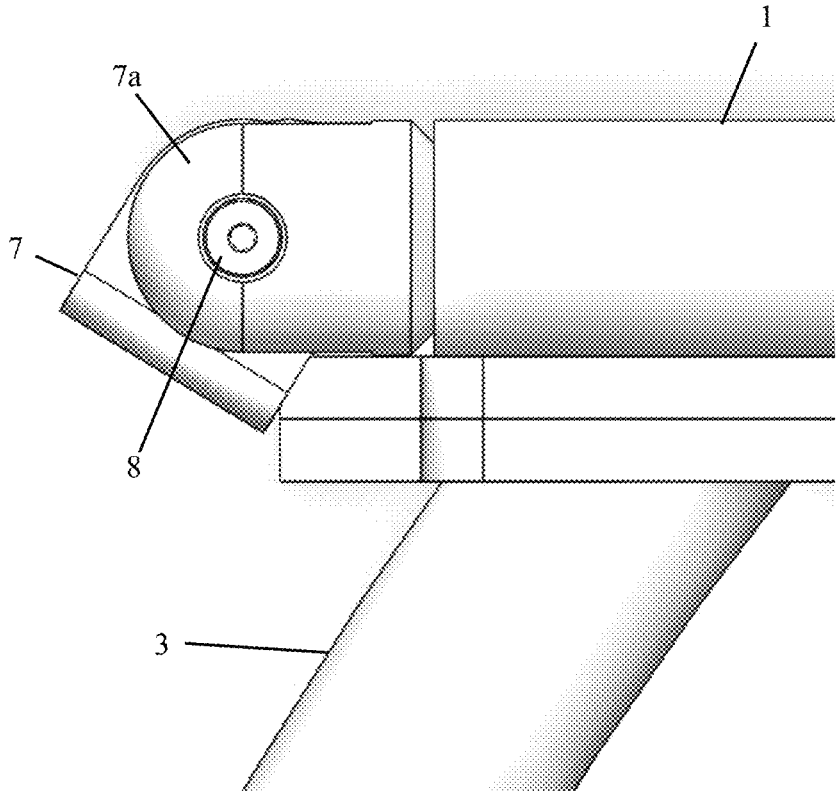
Figure 6G:
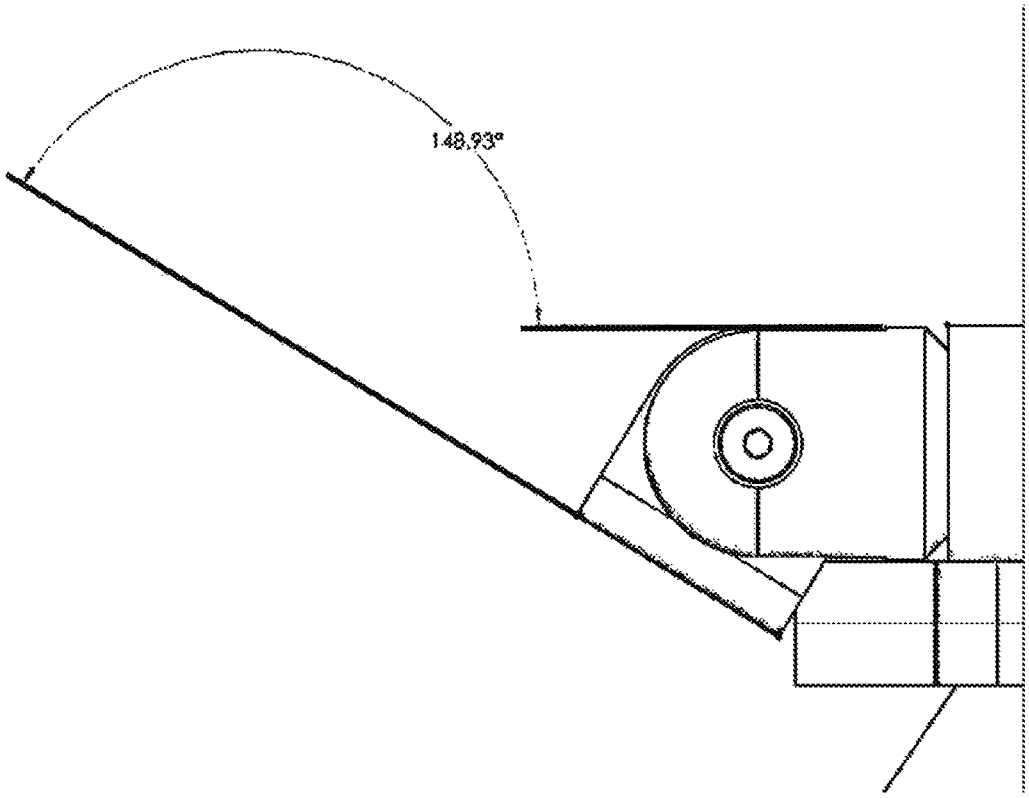

As noted previously, the channels 7*a* and the brackets 7 cooperate to provide recessed mounting of the seat base 1 which has the seat cushion 14 thereon. This structure also enables an increased range of swing of the seat top 14 as compared to conventional leaning post structures. Accordingly, with reference to FIGS. 6F and 6G, the brackets 7 are shown as swung open, measured to be 148.93 degrees of swing. Conventional hinges utilized to connect seat tops to leaning posts are typically limited to about 90 degrees of swing. It will be appreciated that the range of swing is measured from the closed position of the brackets 7 in which the seat top 14 closes on the top of the legs 2 and 3, such as depicted in FIGS. 6C-6E.

The modular leaning posts according to the disclosure provide leaning post structures that are of modular and adjustable design, and which may be disassembled for compact shipping.

The leaning posts as shown and described herein may be broken down for shipping in a package or container having a volume of less than about 150 cubic inches which is much smaller than the assembled dimensions of the leaning post. In contrast, if shipped assembled, the leaning posts would require a package or container having a substantially greater volume corresponding to the assembled dimensions of the leaning post, and typically at least about 196 cubic inches or more.

Accordingly, the disclosure enables more cost-effective manufacture and shipping, while providing the customer with a leaning post that may be readily assembled. In addition, the modular leaning posts enable configuration changes based on boat builder and end user needs to be able to be made quickly and easily in the field.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A modular leaning post kit for a boat, comprising:

a seat base and a pair of seat legs, the seat base being removably installable onto tops of the seat legs to provide an assembled leaning post structure, and the assembled leaning post structure being installable onto a boat;

an upholstered seat top pivotally mounted to the seat base, the seat base including channels and the upholstered seat top including hinge brackets pivotally pinned into the channels at a location forward of the tops of the seat legs to pivotally mount the upholstered seat top to the seat base to enable the upholstered seat top to be rotated to allow access under the seat base and the upholstered seat top has an angle of swing relative to the seat base of from 0 to at least about 148 degrees; and additional leaning post structures that may optionally be added onto the assembled leaning post structure, comprising one or more of a foot rest, a grab rail, a back rest/fishing rod holder, and an upholstered back rest.

2. The modular leaning post of claim 1, wherein the grab rail is installable onto the seat base.

3. The modular leaning post of claim 1, wherein the back rest/fishing rod holder is installable onto the seat base.

4. The modular leaning post of claim 1, wherein the foot rest is installable onto the seat legs.

5. The modular leaning post of claim 1, wherein the upholstered back rest is installable onto the back rest/fishing rod holder.

6. The modular leaning post of claim 1, wherein the legs include receivers and the foot rest includes foot rest ends pivotally mountable to the receivers to enable the foot rest to be adjusted between a raised position and a level position, the foot rest ends including a raised position stop surface and a level position stop surface.

* * * * *